US008348363B2

(12) United States Patent
Yamamoto

(10) Patent No.: US 8,348,363 B2
(45) Date of Patent: Jan. 8, 2013

(54) INK TANK THAT ENABLES INK REMAINING AMOUNT TO BE DETECTED PROGRESSIVELY

(75) Inventor: Hajime Yamamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 235 days.

(21) Appl. No.: 12/385,722

(22) Filed: Apr. 17, 2009

(65) Prior Publication Data

US 2009/0207199 A1 Aug. 20, 2009

Related U.S. Application Data

(62) Division of application No. 10/587,458, filed as application No. PCT/JP2005/008580 on Apr. 28, 2005, now Pat. No. 7,537,324.

(30) Foreign Application Priority Data

Apr. 30, 2004 (JP) ..... 2004-135851

(51) Int. Cl.
*B41J 2/195* (2006.01)
*B41J 29/393* (2006.01)
*B41J 2/175* (2006.01)

(52) U.S. Cl. ..... 347/7; 347/19; 347/85

(58) Field of Classification Search ..... 347/6, 7, 347/86

See application file for complete search history.

(56) References Cited

U.S. PATENT DOCUMENTS 4,551,734 A 11/1985 Causley et al. ..... 346/140 R
5,509,140 A 4/1996 Koitabashi et al. ..... 347/86
5,596,351 A 1/1997 Stapleton ..... 347/7
5,852,946 A * 12/1998 Cowger ..... 347/7
5,975,665 A 11/1999 Torigoe et al. ..... 347/7
6,012,794 A 1/2000 Nakano et al. ..... 347/7
6,012,808 A 1/2000 Koitabashi et al. ..... 347/86
6,206,513 B1 * 3/2001 Tajima et al. ..... 347/86
6,302,503 B1 * 10/2001 Seu ..... 347/7
6,325,500 B1 12/2001 Kitabatake et al. ..... 347/86
6,422,674 B1 7/2002 Hinami et al. ..... 347/7
6,502,917 B1 * 1/2003 Shinada et al. ..... 347/19

(Continued)

FOREIGN PATENT DOCUMENTS

JP 07237300 A * 9/1995

(Continued)

OTHER PUBLICATIONS

Machine generated English translation of JP 07-237300A to Ikegami et al. "Ink Jet Recorder"; generated on May 11, 2012 via http://www4.ipdl.inpit.go.jp/; 4 pp.*

*Primary Examiner* — Shelby Fidler
(74) *Attorney, Agent, or Firm* — Fitzpatrick, Cella, Harper & Scinto

(57) ABSTRACT

There is provided a liquid tank having a liquid remaining amount sensing module that makes it possible to reliably determine that the amount of ink has reached a predetermined value, in spite of its simple and compact configuration. In the ink tank, an information storage element and a module are provided on a ceiling portion of an ink accommodating chamber directly accommodating ink; the module having an optical reflector that faces downward in a vertical direction. A housing of the ink tank is composed of a transparent resin. Infrared light from an external light emitting section is incident on the optical reflector. The reflected light is received by a light receiving section and then, the quantity of light is measured.

11 Claims, 13 Drawing Sheets

U.S. PATENT DOCUMENTS

| | | | | |
|---|---|---|---|---|
| 6,530,654 | B2 | 3/2003 | Kitabatake et al. | 347/86 |
| 6,609,461 | B2 | 8/2003 | Horii et al. | 101/484 |
| 6,616,255 | B2 | 9/2003 | Murakami et al. | 347/7 |
| 6,719,394 | B2 | 4/2004 | Kubota et al. | 347/19 |
| 6,869,158 | B2 | 3/2005 | Kojima et al. | 347/19 |
| 6,935,716 | B2 | 8/2005 | Hatasa et al. | 347/19 |
| 6,994,415 | B2 | 2/2006 | Asauchi et al. | 347/19 |
| 6,994,431 | B2 * | 2/2006 | Kitabatake et al. | 347/86 |
| 7,029,107 | B2 | 4/2006 | Kitabatake et al. | 347/86 |
| 7,055,926 | B2 | 6/2006 | Kojima et al. | 347/19 |
| 7,101,012 | B2 | 9/2006 | Kosugi et al. | 347/19 |
| 7,111,919 | B2 | 9/2006 | Hatasa et al. | 347/19 |
| 7,213,914 | B2 | 5/2007 | Anma et al. | 347/86 |
| 2001/0002137 | A1 * | 5/2001 | Udagawa | 347/86 |
| 2001/0035887 | A1 * | 11/2001 | Altfather et al. | 347/7 |
| 2002/0043173 | A1 * | 4/2002 | Horii et al. | 101/484 |
| 2004/0017445 | A1 * | 1/2004 | Kojima et al. | 347/19 |
| 2004/0041859 | A1 * | 3/2004 | Hwang | 347/7 |
| 2004/0135862 | A1 * | 7/2004 | Merz et al. | 347/100 |
| 2004/0246283 | A1 * | 12/2004 | Merz et al. | 347/7 |
| 2005/0151811 | A1 | 7/2005 | Shimizu et al. | 347/86 |
| 2005/0219303 | A1 * | 10/2005 | Matsumoto et al. | 347/19 |
| 2005/0270315 | A1 | 12/2005 | Yamamoto | 347/7 |
| 2005/0270347 | A1 | 12/2005 | Yamamoto | 347/86 |
| 2007/0052741 | A1 | 3/2007 | Yamamoto | 347/7 |
| 2007/0052774 | A1 | 3/2007 | Shimizu et al. | 347/86 |
| 2007/0268325 | A1 * | 11/2007 | Watanabe | 347/19 |

FOREIGN PATENT DOCUMENTS

| | | | |
|---|---|---|---|
| JP | 2951818 | | 7/1999 |
| JP | 11334098 | A * | 12/1999 |
| JP | 2000-190520 | | 7/2000 |
| JP | 2001-293883 | | 10/2001 |
| JP | 2002-011928 | | 1/2002 |
| JP | 3397441 | | 2/2003 |

* cited by examiner

INK TANK THAT ENABLES INK REMAINING AMOUNT TO BE DETECTED PROGRESSIVELY

This application is a division of U.S. application Ser. No. 10/587,458, filed Jul. 27, 2006, which was a National Stage application of PCT/JP2005/008580, filed Apr. 28, 2005, the contents of which are incorporated herein by reference.

TECHNICAL FIELD

The present invention relates to a liquid tank (ink tank) accommodating a liquid such as ink which is supplied to a print head (ink jet print head) that ejects the liquid for printing, and an ink jet printing apparatus in which the liquid tank is mounted for printing.

BACKGROUND ART

Japanese Patent No. 2951818 discloses a known ink tank provided in an ink jet printing apparatus to supply a liquid such as ink (simply referred to as "ink" below) to an ink jet print head that ejects the ink in order to print on a print medium. FIG. 13A shows an ink tank 501 as an example utilizing the above configuration.

In the ink tank 501, a housing 504 composed of a container 502 and a cover 503 is partitioned into two spaces using a partitioning wall 514 having a communication portion 509. One of the two spaces is an ink accommodating chamber 506 which is closed except for the communication portion 509 of the partitioning wall 514 and which directly houses ink 515. The other space is a negative pressure generating member accommodating chamber 505 that houses a negative pressure generating member 511.

The ink tank 501 is detachably installed on a carriage (not shown) in an ink jet printing apparatus main body by using a lever 520; the carriage is reciprocated. An ink supply port 510 is formed in a bottom wall surface forming the negative pressure generating member accommodating chamber 505; an ink lead-out member 1203 is placed in the ink supply port 510 to supply the ink to an ink jet print head portion (not shown) supported on the carriage together with the ink tank 501. Further, an air communication port 508 is formed in a part of the cover 503 which forms a top wall surface of the negative pressure generating member housing chamber 505; the air communication port 508 is used to lead the air into the ink tank 501 as the ink 515 is led out. A gas introduction groove 519 is formed in an inner wall surface of the partitioning wall 514; the gas introduction groove 519 extends upward from an upper end of the communication portion 509.

The ink 515 is held in the negative pressure generating member housing chamber 505 by being absorbed by the negative pressure generating member 511. If an upper end of the gas introduction groove 519 is below the boundary between an area in which the ink 515 is held in the negative pressure generating member 511 and an area into which the air has entered, that is, below a gas/liquid interface, the air is introduced through the air communication port 508 as the ink is led out of the ink supply port 510. This lowers the gas/liquid interface.

Once the gas/liquid interface 511*a* lowers and reaches the upper end of the gas introduction groove 519 as the ink is consumed, air is introduced into the negative pressure generating member housing chamber 505 through the air communication port 508, and then the air enters the ink accommodating chamber 506 through the gas introduction groove 519 and communication portion 509 in the partitioning wall 514.

Instead, the ink 515 from the ink accommodating chamber 6 is introduced into the negative pressure generating member housing chamber 505 through the communication portion 509 in the partitioning wall 514. This is called a gas and liquid exchanging operation; in this operation, air and the ink are exchanged between the negative pressure member housing chamber 505 and the ink accommodating chamber 506. In the gas and liquid exchanging operation, the gas introduction groove 519 serves to promote the introduction of the air from the negative pressure generating member housing chamber 505 into the ink accommodating chamber 506.

With the gas and liquid exchanging operation, even though the ink is consumed by the print head, an amount of ink equal to the amount of ink consumed is introduced into negative pressure generating member 11. Accordingly, the negative pressure generating member 11 is kept holding an approximately constant amount of ink. The gas/liquid interface 511*a* is thus maintained almost at the illustrated position. This allows the ink to be stably supplied to the print head, thus maintaining an almost constant negative pressure required to hold ink meniscus formed at ink ejection openings in the print head.

Another known configuration for adjusting the negative pressure on the ink in the ink tank is an ink accommodating chamber formed of a hard case and in which the ink is directly accommodated; as the ink is supplied to the print head, air (the atmosphere) from outside the ink tank is introduced directly into the ink accommodating chamber. With this configuration, when the ink is led out of the ink accommodating chamber as ink is supplied to the print head, the pressure in the ink accommodating chamber lowers. The decrease in pressure is offset by the air introduced into the ink accommodating chamber. This suppresses an excessive increase in negative pressure, thus maintaining an appropriate negative pressure.

The following advantages are given by the configuration in which the ink is accommodated directly in the ink accommodating chamber formed of the hard case: the efficiency with which the ink is accommodated can be increased, and almost all the accommodated ink can be used. On the other hand, the configuration shown in FIG. 13A utilizes the negative pressure generating member 511 to enable a more stable ink supply. This configuration further utilizes the ink accommodating chamber in which the ink is directly accommodated to enable an increase in the efficiency with which the ink is accommodated and used.

In either case, the ink tank used in the ink jet printing apparatus generally has a finite amount of ink accommodated and is configured to be detachable from the printing apparatus. When the ink is consumed up, the ink tank is replaced with a new one.

Desirably, the replacement of the ink tank is appropriately carried out when the ink in the ink tank is used up. Thus, the ink jet printing apparatus may be provided with an arrangement that determines the amount of ink remaining in the ink tank in order to notify the user of the appropriate time to replace the ink tank with a new one or to prevent a printing operation from being performed when the ink is exhausted. A known example of such an arrangement is a mechanism provided in the ink tank to detect that the ink remaining amount has reached a predetermined value. Various arrangements serving as such a detecting mechanism have been proposed and put to practical use.

In the configuration shown in FIG. 13A, an optical reflector 513 is provided at the bottom of the ink accommodating chamber 506 as means for detecting that the ink remaining amount has reached a predetermined value. The optical reflector 513 is composed of a material having a refractive index similar to that of the ink. As shown in FIGS. 13B and 13C, the optical reflector 513 is shaped like a prism with a vertical angle of 90°. In the printing apparatus main body, an optical module 551 having a light emitting section 552 and a light receiving section 553 is placed opposite the optical reflector 513. In this configuration, as shown by reference numeral 560, the light emitting section 552 irradiates the bottom of the ink accommodating chamber 506 with light. The light is transmitted through the bottom and is incident on a surface of the optical reflector 513 which has an inclination of 45° and which faces the interior of the ink accommodating chamber 506. When the ink accommodating chamber 506 contains a sufficient amount of ink, most of the thus incident light is refracted and then enters the ink accommodating chamber 506 as shown by reference numeral 561. Therefore, on this occasion, the light receiving section 553 detects little light. On the other hand, when the amount of ink in the ink accommodating chamber 506 decreases, such as to a level shown at 521, the light emitting section 552 irradiates the ink accommodating chamber 506 with light while the faces of the optical reflector 513 which face the interior of the ink accommodating chamber 506 are not in contact with the ink. Then, as shown by reference numerals 562 and 563, most of the applied light is reflected by the two 45° inclined surfaces of the optical reflector 513 which face the interior of the ink accommodating chamber 506. The light is then led to the light receiving section 553. In this manner, it is possible to determine whether or not the level of the ink in the ink accommodating chamber 506 has lowered to such a degree that the optical reflector 513 is exposed, on the basis of the quantity of light detected by the light receiving section 553.

Mechanisms that optically detect that the ink remaining amount has reached a predetermined value are disclosed in Japanese Patent Publication No. 3397441 and Japanese Patent Laid-Open Publication No. 2000-190520. Besides the mechanism using light, the following are known: a mechanism in which a pair of electrodes are provided in the ink tank so that detection is executed on the basis of a variation in the electric conductivity of the ink between the electrodes and a mechanism that executes detection on the basis of a variation in electrode capacitance generated between the ink tank and an electrode provided outside.

In any case, the mechanism determines whether or not the level of the ink has become equal to or lower than a certain height. If a single mechanism is provided, it is often placed on or near the bottom surface. Further, a configuration is also known in which a plurality of such mechanisms are provided so as to detect the level of the remaining ink and thus the amount of ink at multiple levels. Alternatively, it is possible to combine plural types of such mechanisms together to detect the ink remaining amount at multiple levels.

Another configuration that determines the amount of ink in the ink tank is a dot count method of using, for example, a control section of an ink jet printing apparatus to count the amount of ink consumed by a printing operation or the like after the ink tank has been installed, to estimate the amount of ink remaining in the ink tank. This configuration is also known to combine with a configuration in which the ink tank is provided with the above mechanism for detecting the amount of ink remaining in the ink tank.

Further, the above detachable ink tank is known to include a mechanical ID structure or bar code label indicating information such as the type of the ink tank or electric information storing means (ROM or the like) in order to, for example, prevent erroneous installation.

DISCLOSURE OF THE INVENTION

As described above, in the configuration in which an ink tank is provided with a mechanism detecting the ink remaining amount, the ink tank must be provided with members used for the detecting mechanism. However, it is not preferable for a particularly small-sized ink tank to be provided with a detecting mechanism that is disadvantageous in cost, space, and ink housing efficiency. Further, it is not preferable to provide a plurality of members for sensing the ink remaining amount continuously or at multiple levels. Furthermore, with the dot count method, it is difficult to increase the accuracy with which to determine the ink remaining amount. It is therefore desirable to provide an inexpensive and small-sized detecting mechanism and to enable the ink remaining amount to be detected in an analog manner while using a single member.

It is therefore an object of the present invention to provide a simple and compact liquid remaining amount sensing means which can reliably determine that the ink remaining amount has reached a predetermined value.

It is another object of the present invention to provide a simple and compact liquid remaining amount sensing means which can accurately and continuously sense the ink remaining amount.

In a first aspect of the present invention, there is provided a liquid tank having a liquid accommodating chamber directly accommodates a liquid, the tank comprising:

a liquid remaining amount sensing module including an optical reflector and an information storage element and disposed on a wall of a member forming the liquid chamber so that a reflecting surface of the optical reflector faces an interior of the liquid accommodating chamber, wherein the member has a light transmittance portion at a wall opposite the wall on which the liquid remaining amount sensing module is disposed, such that light can incident onto the optical reflector from an exterior and the light reflected by the optical reflector can exit to the exterior, through the light transmittance portion and the liquid accommodating chamber.

In a second aspect of the present invention, there is provided an ink jet printing apparatus in which the liquid tank according to claim 1 is detachably installed and which executes printing by ejecting a liquid supplied by the liquid tank, the apparatus comprising:

light emitting means for externally applying light to the wall of the liquid tank which is opposite the wall on which the liquid remaining amount sensing module is placed;

light receiving means for detecting the resulting quantity of light after being applied by the light emitting means, reflected by the reflector of the liquid remaining amount sensing module and finally exit to the exterior of the liquid tank;

means for calculating the amount of liquid remaining in the liquid tank on the basis of the quantity of light detected by the light receiving means; and means for providing information on the calculated remaining amount to the information storage element of the liquid remaining amount sensing module.

According to this configuration, light is incident on the optical reflector on the liquid remaining amount sensing module in which the information storage element is mounted. Light is reflected by the optical reflector and then passes through the liquid. The length of the optical path passing through the liquid varies depending on the amount of liquid remaining in the liquid accommodating chamber. Accordingly, the quantity of light varies depending on the amount of liquid remaining in the liquid accommodating chamber. It is thus possible to determine the amount of liquid remaining in the liquid accommodating chamber on the basis of this variation. In this configuration, the liquid tank is provided only with the optical reflector together with the information storage element.

In order to avoid affecting the quantity of light reciprocating within the liquid accommodating chamber and entering the light receiving section, the liquid tank, mounted in the printing apparatus, is desirably configured so as to prevent external light from entering the tank.

According to the present invention, it is possible to sense the amount of liquid remaining in the liquid tank almost without the need to complicate the liquid tank. Therefore, the present invention allows the size of the liquid tank to be easily reduced, while enabling the amount of liquid remaining to be sensed. It is thus easy to reduce the size of the ink jet printing apparatus in which the liquid tank is installed.

The above and other objects, effects, features and advantages of the present invention will become more apparent from the following description of embodiments thereof taken in conjunction with the accompanying drawings.

BRIEF DESCRIPTION OF THE DRAWINGS

FIGS. 1A and 1B are schematic diagrams showing an ink tank according to a first embodiment of the present invention, wherein FIG. 1A is a sectional view showing the configuration of the whole ink tank, and FIG. 1B is an enlarged sectional view of an ink remaining amount sensing module portion;

FIGS. 2A to 2C are diagrams showing the ink remaining amount sensing module shown in FIG. 1B, wherein FIG. 2A is a perspective view of the appearance of the module embedded in the ink tank, and FIGS. 2B and 2C are perspective views of the removed module as viewed from above and below, respectively;

FIGS. 7A and 7B are diagrams showing a non-contact type of information storage element used in a variation of a first embodiment, wherein FIG. 7A is a diagram illustrating the electric connection with the printing apparatus main body, and FIG. 7B is a block diagram showing the configuration of the non-contact type of information storage element;

FIGS. 13A to 13C are diagrams showing a conventional ink tank, wherein FIG. 13A is a sectional view, FIG. 13B is a perspective view of a container, and FIG. 13C is a diagram illustrating an optical ink remaining amount sensing mechanism provided in the ink tank.

BEST MODE FOR CARRYING OUT THE INVENTION

Embodiments of the present invention will be described below with reference to the drawings.

First Embodiment

Figure 1A:
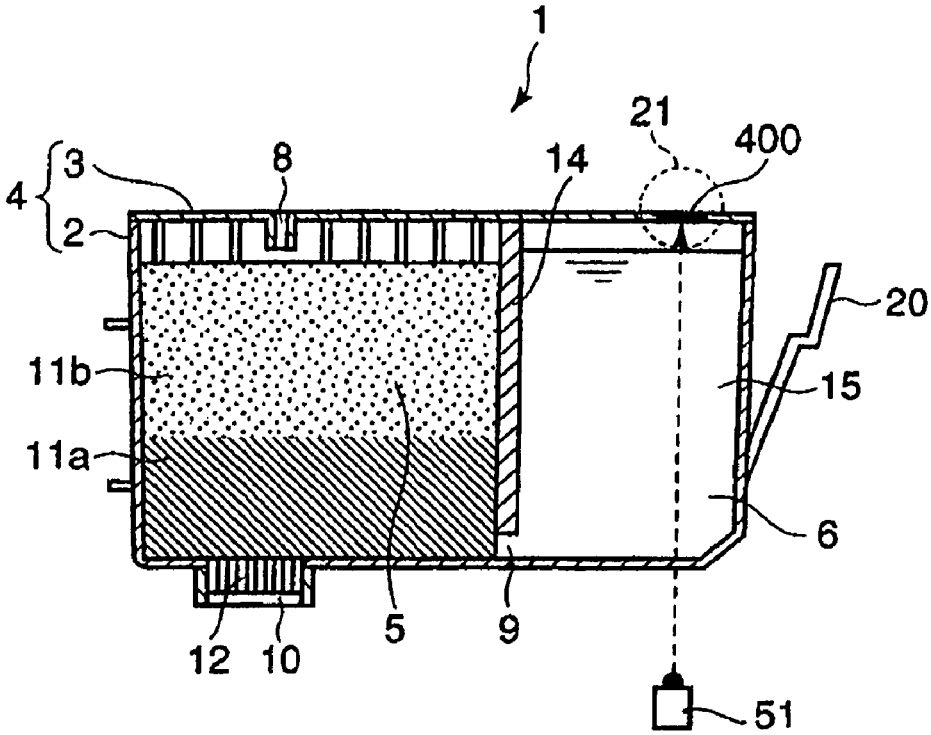

FIG. 1A is a sectional view schematically showing the configuration of an ink tank (liquid tank) 1 according to a first embodiment of the present invention.

In the ink tank 1, a housing 4 composed of a container 2 and a cover 3 is partitioned into two independent spaces using a partitioning wall 14; the spaces are in communication only via a communication portion 9 in the lower part of the partitioning wall 14. One of the two spaces is a negative pressure generating member housing chamber 5 in which two types of negative pressure generating members 11*a* and 11*b* are stacked and housed. The other space is an ink accommodating chamber (liquid accommodating chamber) 6.

The ink tank 1 is detachably installed on a carriage (not shown) in an ink jet printing apparatus main body using a lever 20; the carriage can be reciprocated. An ink supply port 10 is formed in a bottom wall of the negative pressure generating member accommodating chamber 5; an ink lead-out member 12 is placed in the ink supply port 10 to supply the ink to an ink jet print head supported on the carriage together with the ink tank 1. Further, an air communication port 8 is formed in a part of the cover 3 which forms a ceiling portion of the negative pressure generating member housing chamber 5. The ink accommodating chamber 6 is closed except for the communication portion 9.

The ink in the ink housing chamber 6 is appropriately fed to the negative pressure generating member housing chamber 5 via the communication portion 9 by a gas and liquid exchanging operation performed by the housing chamber 6 in cooperation with the negative pressure generating member housing chamber 5. This keeps the negative pressure generating member 11 holding an appropriate amount of ink. The negative pressure generating member 11 exerts an appropriate negative pressure to supply the ink from the ink tank 1 to an ink jet print head under a negative pressure within an almost fixed predetermined range.

Figure 1B:
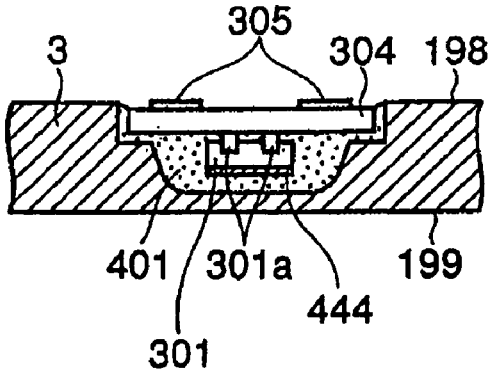
Figure 2A:
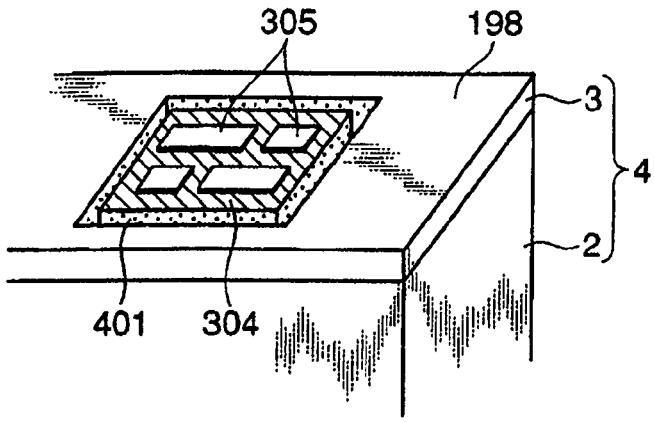
Figure 2B:
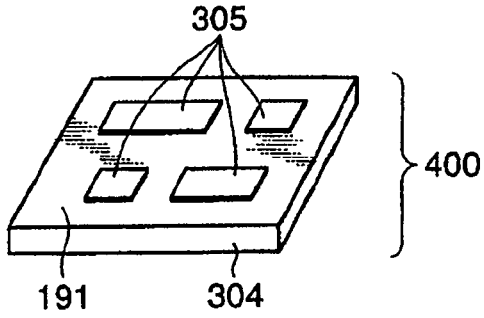
Figure 2C:
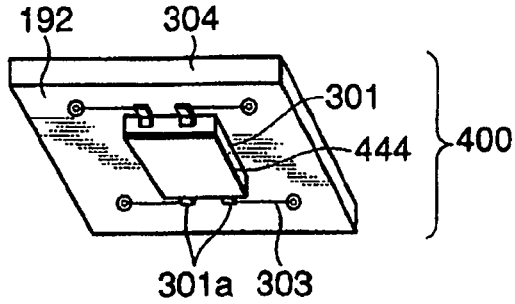

An ink remaining amount sensing module 400 is provided in a part of the cover 3 which forms the ceiling portion of the ink housing chamber 6. An information storage element 301 is mounted on the ink remaining amount sensing module 400. FIG. 1B is an enlarged view of a part of FIG. 1A which is enclosed by a broken line 21 and in which the ink remaining amount sensing module 400 is provided. FIG. 2A is a perspective view of the appearance of the part in which the ink remaining amount sensing module 400 is provided. FIGS. 2B and 2C are perspective views showing a top surface 191 and a bottom surface 192 of the ink remaining amount sensing module 400.

The ink remaining amount sensing module 400 has a substrate or support member 304. The information storage element 301 is mounted on the bottom surface 192 of the support member 304; the information storage element 301 is an electrically writable and erasable EEPROM in this example. The information storage element 301 is packaged using a mold. The information storage element 301 is electrically connected to wiring patterns 303 via lead terminals 301*a* integrated with the package and formed so as to project from the package; the wiring patterns 303 are formed on the support member 304, which also has the functions of a printed circuit board. The wiring patterns 303 are connected to contact pads 305 formed on the top surface 191 through the support member 304.

The support member 304, on which the information storage element 301 and the contact pads 305 are mounted, is embedded in a recess formed in an outer surface 198 of the cover 3 so that the contact pads 305 are exposed from the outer surface 198. Reference numeral 199 refers to an inner surface of cover 3. The support member 304 is then sealed and fixed using a sealing adhesive 401. In this case, an optical reflector 444 is tightly placed on a surface of the information storage element 301 which is opposite a side facing the support member 304 and which is covered with the mold; the optical reflector 444 is, for example, a stainless steel mirror formed by polishing a thin plate of stainless steel. Thus, the optical reflector 444 is placed so that its reflecting surface faces downward in a vertical direction when the tank 1 is used.

Figure 3:
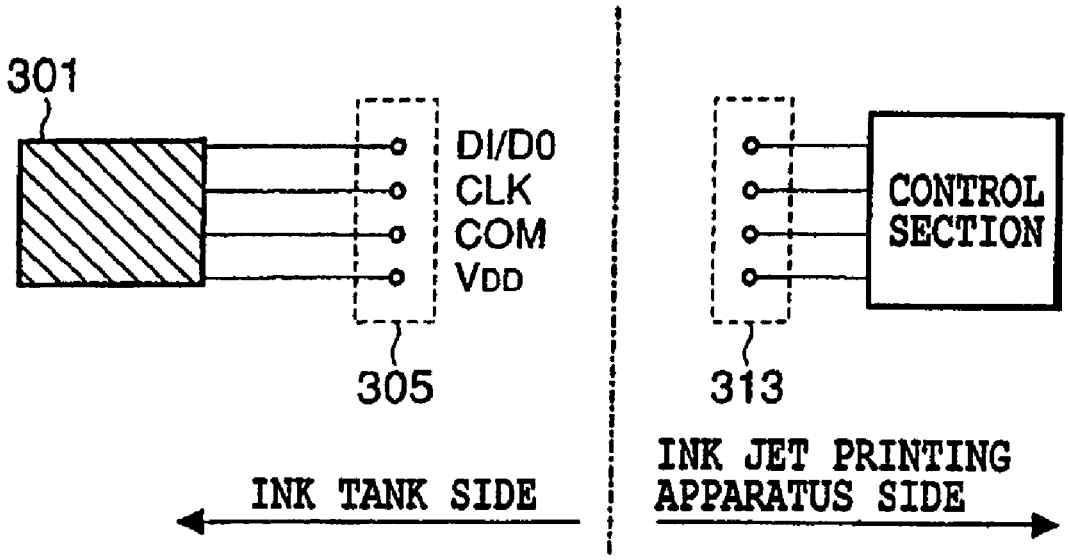
FIG. 3 is a diagram showing the electric connection between the ink remaining amount sensing module shown in FIG. 1B and an ink jet printing apparatus main body.
Figure 4:
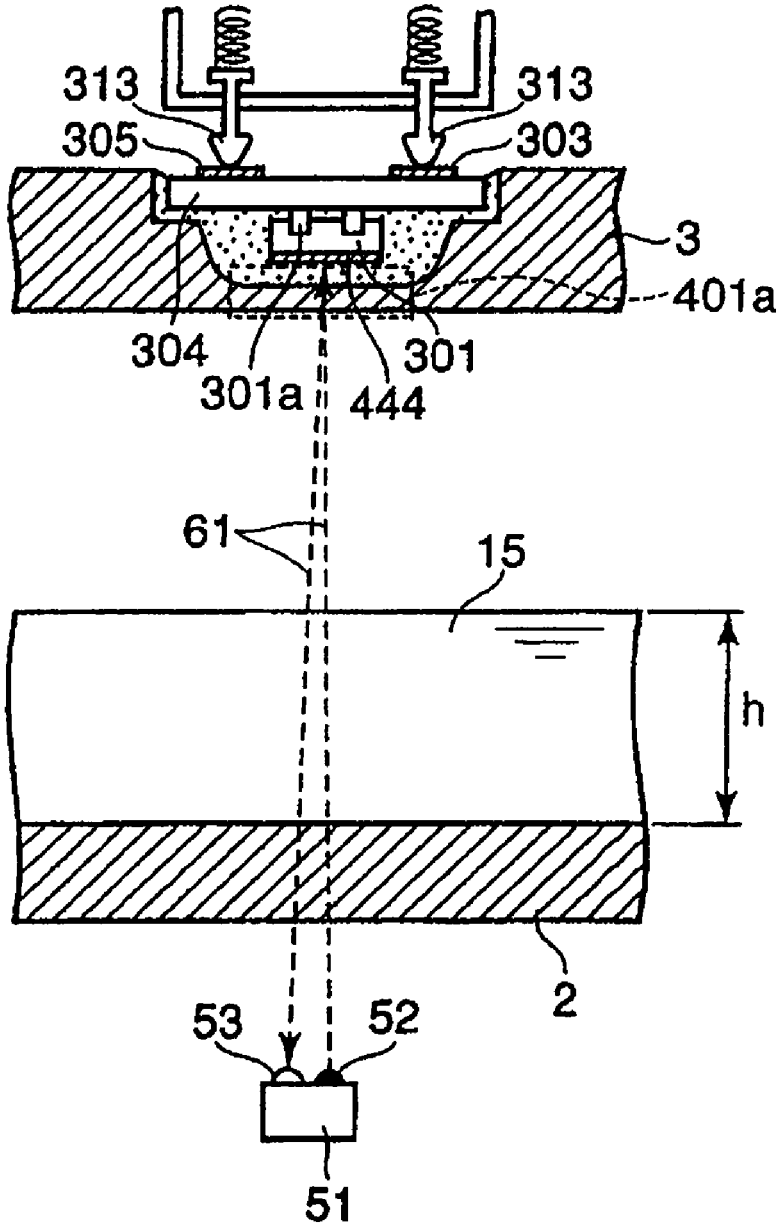
FIG. 4 is a schematic sectional view illustrating how to sense the amount of ink remaining in the ink tank in FIG. 1A.

In this example, four contact pads 305 are provided. The contact pads 305 are used for electrically connecting a power source Vdd, a COM, a clock CLK, and a data I/O Din/Dout (DI/DO) (see FIG. 3) which are required for operations of the information storage element 301. As shown in FIG. 4, connector terminals 313 are provided in the printing apparatus main body in a pattern corresponding to the contact pads 305. When the ink tank 1 is mounted on a carriage in the printing apparatus main body, each of the connector terminals 313 is connected to the corresponding contact pad 305. This enables the control section of the printing apparatus main body to write and read required information to and from the information storage element 301.

A module 51 is placed in the printing apparatus main body and below a reciprocating path for the carriage; the module 51 emits and receives infrared light. The light emitting and receiving module 51 has a light emitting section 52 that irradiates a target with infrared focused light and a light receiving section 53 that receives infrared light to detect the quantity of the infrared light. The light emitting section 52 and the light receiving section 53 are directed upward almost in the vertical direction so as to face the bottom surface of the ink tank 1 mounted on the carriage when the ink tank 1 is located at a predetermined position.

In the ink tank according to the present embodiment, the whole housing 4 is formed of a transparent resin. The sealing adhesive 401, which fixes the ink remaining amount sensing module 400, allows infrared light to pass through. Accordingly, infrared focused light from the light emitting section 52 of the light emitting and receiving module 51 can travel along an optical path extending upward in the vertical direction through a bottom surface of the container 2, the ink 15 in the ink accommodating chamber 6, the cover 3, and the sealing adhesive 401. The optical reflector 444 and the light emitting and receiving module 51 of the ink remaining amount sensing module 400 are relatively arranged so that the optical reflector 444 crosses the optical path of infrared focused light while the ink tank 1 is being reciprocated by the carriage; the infrared focused light is applied by the light emitting section 52 of the light emitting and receiving module 51 and travels upward almost in the vertical direction.

Figure 5:
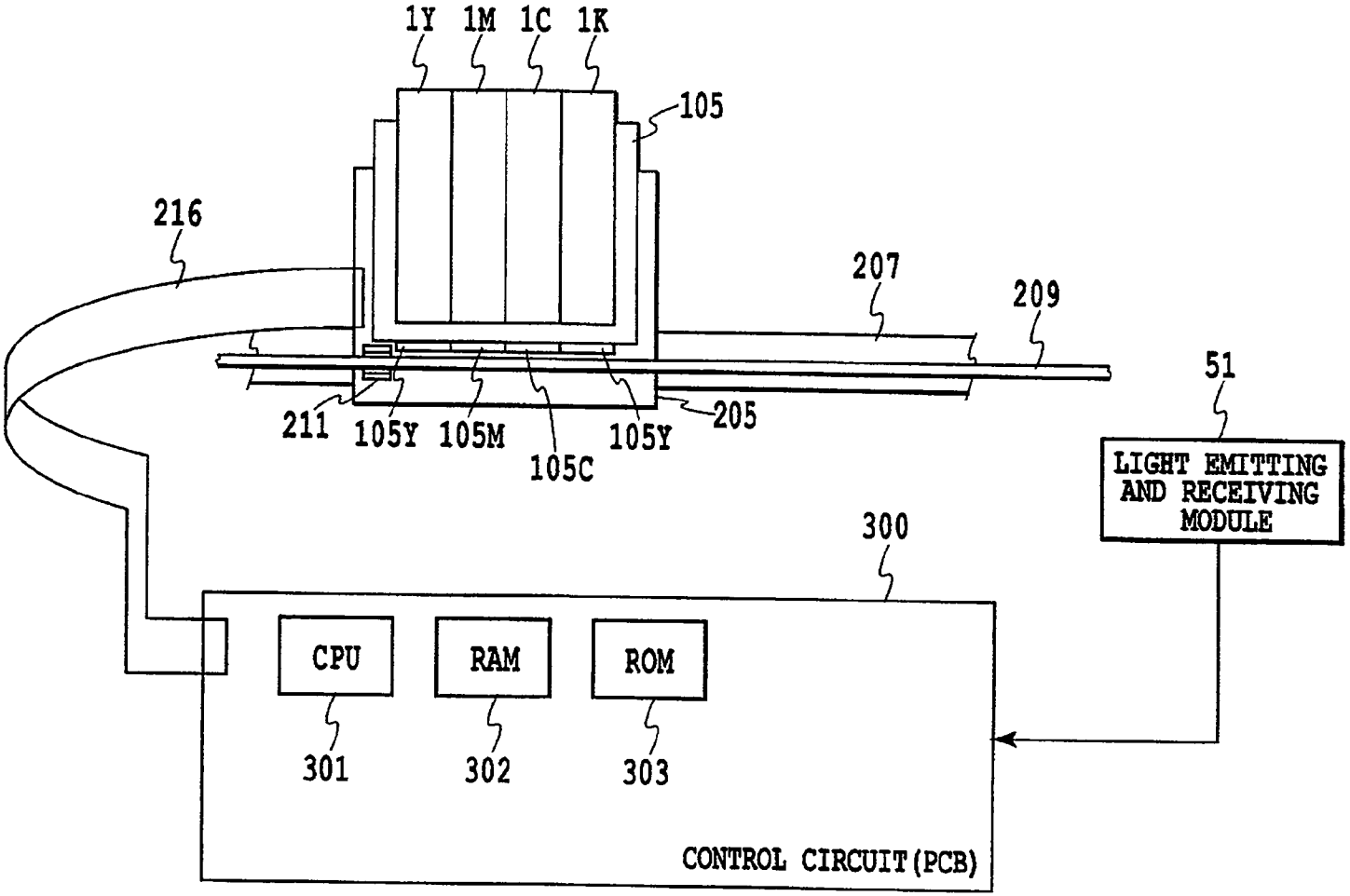
FIG. 5 is a schematic diagram showing the configuration of an ink jet printing apparatus to which the present invention is applicable.

FIG. 5 is a schematic diagram of the configuration of the ink jet printing apparatus. This figure mainly shows a configuration relating to a control circuit in PCB (Printed Circuit Board) form which is provided in the printing apparatus main body.

Figure 6:
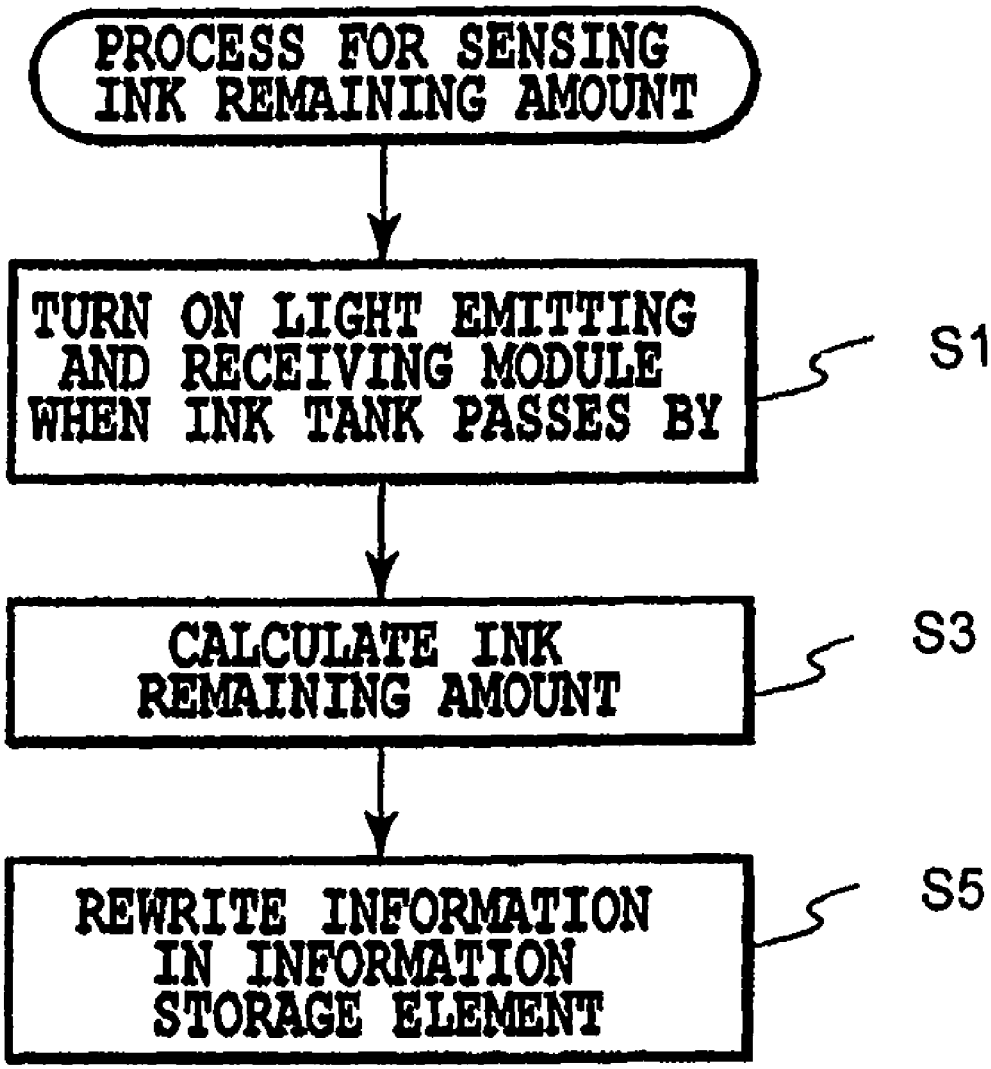
FIG. 6 is a flowchart showing a process procedure for sensing the ink remaining amount sensing which procedure is executed by the printing apparatus in FIG. 5.

In FIG. 5, a control circuit 300 executes data processing and operational control for the printing apparatus. Specifically, a CPU 301 executes a process for detecting the ink remaining amount as shown in FIG. 6 as well as other required processes for controlling printing operations, in accordance with programs stored in a ROM 303. A RAM 302 is used as a work area when the CPU 301 executes processing.

As schematically shown in FIG. 5, a print head unit 105 mounted on a carriage 205 comprises, for example, print heads 105K, 105Y, 105M, and 105C in which a plurality of ejection openings are formed in order to eject a black (K), yellow (Y), magenta (M), and cyan (C) inks, respectively. Ink tanks 1K, 1Y, 1M, and 1C according to the present embodiment are detachably mounted in a holder of the print heat unit 105 in association with the respective print heads.

As previously described, the ink remaining amount sensing module 400, on which the information storage element 301 and the optical reflector 444 are provided, is attached to each of the ink tanks. When the ink tank 1 is correctly installed on the print head unit 105, the contact pads 305 come into contact with the connector terminals 313 provided on the print head unit 105 in association with the ink tank 1. This enables the control section of the printing apparatus main body to write and read required information to and from the information storage element 301.

A connector (not shown) provided on the carriage 205 is connected to the control circuit 300 in the main body via a flexible cable 216 so as to enable signal transmissions. Moreover, when the print head unit 105 is installed on the carriage 205, the connector of the carriage 205 is connected to the connector of the print head unit 105 so as to enable signal transmissions. The above connection configuration enables the control circuit 300 of the main body to transmit and receive signals to and from each ink tank 1.

In connection with the control of ink ejections in the print heads 105K, 105Y, 105M, and 105C, a driving circuit and the like provided on the print head are similarly connected to the control circuit 300 in the main body via the flexible cable 216, the connector of the carriage 205, and the connector of the print head unit so as to enable signal transmissions. This enables the control circuit 300 to control ink ejection and the like in each print head.

Further, an encoder scale 209 is provided along a route of the carriage 205. The carriage 205 is provided with an encoder sensor 211. A detection signal from the sensor is input to the control circuit 300 via the flexible cable 216. This makes it possible to determine the moving position of the carriage 205. This positional information is used to control ejection from each print head. Moreover, the light emitting and receiving module 51 is provided near a predetermined position within the moving range of the carriage 205.

FIG. 6 is a flowchart showing a process procedure for sensing the ink remaining amount according to the present embodiment.

A printing operation is performed by the ink jet printing apparatus by causing the ink jet print head to selectively eject ink while reciprocating the carriage 205 along a guide shaft 207. In this case, upon reaching a position where the ink tank 1 crosses an optical path 60 of infrared focused light applied by the light emitting section 52 of the light emitting and receiving module, the ink tank 1 is irradiated with the infrared focused light (step S1). Then, as shown by a broken line 60 in FIG. 4, the light reaches the optical reflector 444 via the resin at the bottom of the container 2, the ink in the ink accommodating chamber 6, the air above the ink in the ink accommodating chamber 6, the inner surface of the cover 3, and the sealing adhesive. The light is then reflected by the optical reflector 444. As shown by a broken line 61 in FIG. 4, the reflected light travels downward almost in the vertical direction. The light thus reaches the light receiving section 53 through almost the same optical path as that of the emitted light. On this occasion, the length of a part of the optical path in which the ink 15 is present varies with the amount of ink remaining in the ink accommodating chamber 6, that is, the height h of the ink. This varies the quantity of light reaching the light receiving section 53. That is, the quantity of light increases as the amount of ink 15 decreases and the height h of the ink 15 is lowered.

The control section 300 of the printing apparatus main body can determine the ink remaining amount on the basis of the variation in the light quantity. That is, the length of a part of the optical path of light in which the ink 15 is present is determined from the quantity of the light which returns after being emitted and reflected. Consequently, an analog signal is obtained which correlates with the height h of the ink. The ink remaining amount can be continuously determined from this analog signal and the geometrical shape and size of the ink accommodating chamber 6 (step S3). In this case, the ink remaining amount may be determined in an analog manner or at multiple levels. After calculating the ink remaining amount, the control section of the printing apparatus main body can cause this and related information to be immediately stored in the information storage element 301 via the connector terminal 313. That is, the control section can write or rewrite information (step S5). Since the light passes through the ink, if the light quantity varies depending on the color of the ink, corrections may be made for each color for the calculating process.

According to the present embodiment, described above, the ink remaining amount can be sensed by providing the ink tank 1 with the simple optical reflector 444. The optical reflector 444 forms the ink remaining amount sensing module 400 together with the information storage element 301. Such an information storage element 301 has hitherto been frequently provided in the ink tank 15 in order to store information on the type of the ink tank 1 and the like (information on the color of the housed ink). This in turn prevents ink tanks housing other types of inks from being erroneously installed. Accordingly, compared to the conventional configuration, the ink tank 1 need not substantially be complicated in order to enable the ink remaining amount to be sensed. That is, it is possible to sense the ink remaining amount while saving space and cost. Thus, the present embodiment makes it possible to reduce the size of the ink tank and thus the ink jet printing apparatus while enabling the ink remaining amount to be sensed. Further, the ink jet printing apparatus can be configured to use the ink remaining amount calculated on the basis of the quantity of light received detected by the light emitting and receiving module 51, and to perform printing control such that for example, a printing operation cannot be started when the ink remaining amount is almost zero. This improves the reliability of the printing operation.

In the present embodiment, the information storage element 301 is not limited to the EEPROM. It is possible to use any electric, magnetic, or electromagnetic information storage means 301 such as a flash ROM or a magnetic memory. Further, the information storage element 301 is not limited to a one-chip configuration but may have a hybrid configuration. Although the thin plate of stainless steel has been shown as an example of the optical reflector 444, the present invention is not limited to this.

FIG. 1B shows the recess formed in the outer surface of the cover 3 of the ink tank 1 and in which the ink remaining amount sensing module 400 is embedded. However, a through-hole may be formed in the cover 3 so that the ink remaining amount sensing module 400 can be positioned in the through-hole. Then, the ink remaining amount sensing module 400 is fixed by providing the sealing adhesive 401 around the periphery of the module 400. Thus, the optical reflector 444 is exposed in the ink accommodating chamber 6. In this case, the tank housing 4 (and its cover 3) and the sealing adhesive 401 are not present in the area enclosed by a broken line shown by reference numeral 401*a* in FIG. 4. Accordingly, the light can desirably travel straight in the round-trip optical paths 60 and 61. In this case, the sealing adhesive 401 forms apart of the inner surface of the ink accommodating chamber 6 and may contact the ink 15. It is strongly desirable that much attention be paid to liquid resistance and maintenance of adhesion. Alternatively, in this configuration, the optical reflector 444 may be covered with the sealing adhesive 401 rather than being exposed. In this case, it is also strongly desirable that much attention be paid to liquid resistance and maintenance of adhesion and to the shape of a surface of the sealing adhesive 401 because infrared focused light is incident on this surface. Alternatively, the surface shape of the sealing adhesive 401 may be appropriately determined so that both incident and reflected lights are focused. Then, even if the optical path is bent or light is scattered to reduce the quantity of light reflected because the surface of the optical reflector 444 is inclined or undulated with respect to the optical path, it is possible to suppress this to obtain a desired sufficient quantity of light reflected.

Figure 7A:
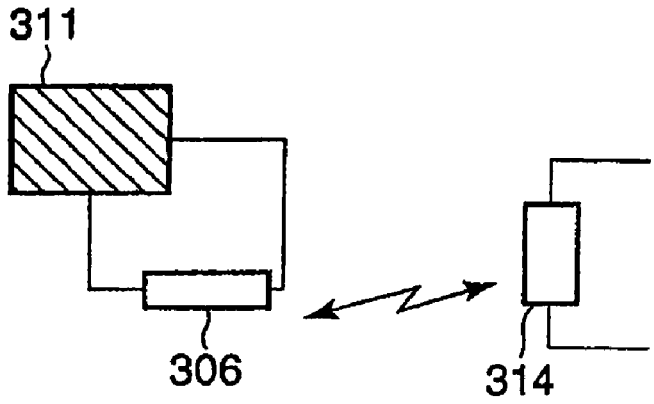
Figure 7B:
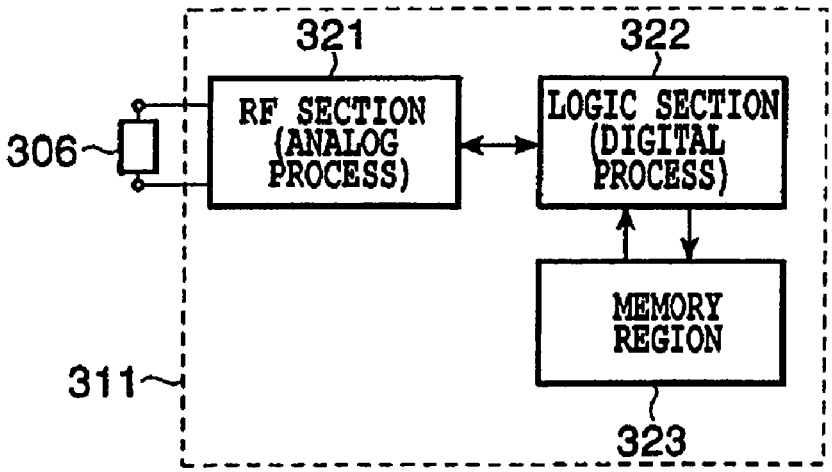

Further, in the present embodiment, the printing apparatus main body can write or read information to and from the information storage element 301 by contacting the connector terminal 313 of the printing apparatus main body directly with the contact pads 305. However, information may be written or read in a non-contact manner. FIGS. 7A and 7B show an example of the configuration of such a non-contact type of information storage element 311. An electromagnetic coupling coil or antenna 306 is connected to the non-contact type of information storage element 311. Thus, the electromagnetic coupling coil or antenna 306 can communicate with an electromagnetic coupling coil or antenna 314 in the main body to execute a process of writing or reading information. As shown in FIG. 7B, the non-contact type of information storage element 311 has a memory region 323, a logic section 322 that executes a digital process such as a process of writing or reading information to or from the memory region 323, and an RF section 321 that converts a digital signal from the logic section 322 into an analog signal for output from the antenna 306 or conversely, converts a signal input via the antenna 306 into a digital signal. This configuration eliminates the need to provide the connector terminal 313 on the carriage.

FIGS. 8A to 8E show an applied example of the present embodiment in which the ink remaining amount sensing module 400 is placed at different positions in respective ink tanks.

Figure 8A:
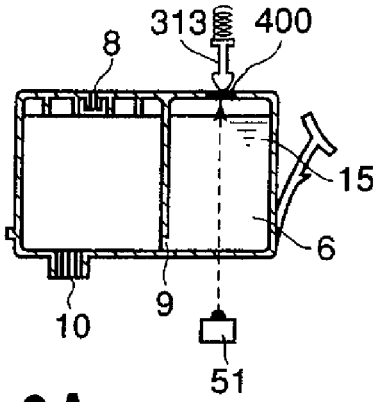
FIGS. 8A to 8E are diagrams showing configurations in which the ink remaining amount sensing module is placed at various positions in various ink tanks.

FIG. 8A shows a configuration corresponding to the above embodiment and in which in an ink tank having the negative pressure generating member accommodating chamber 5 and the ink accommodating chamber 6, the ink remaining amount sensing module 400 is placed on a ceiling portion of the ink housing chamber 6. This configuration enables the remaining amount of the ink to be determined at least at multiple levels by utilizing the fact that the quantity of light detected by the infrared light emitting and receiving module 51 varies in an analog manner in correlation with the amount of ink 15 remaining in the ink accommodating chamber 6.

Figure 8D:
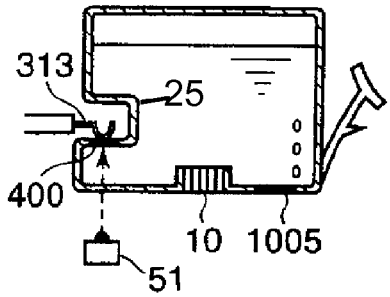
Figure 8B:
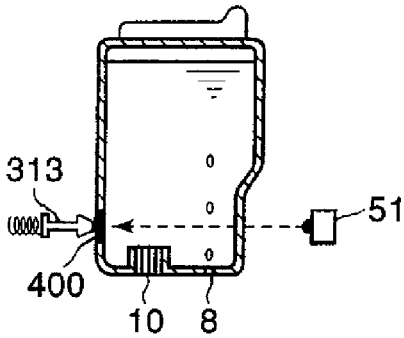

In the configuration shown in FIG. 8B, in an ink tank that has only an ink accommodating chamber directly accommodating ink and in which the ink supply port 10 and the air communication port 8 are formed at its bottom, the ink remaining amount sensing module 400 is placed on a side wall of the ink accommodating chamber. With this configuration, when the level of the remaining ink lowers below the horizontal optical path of light applied by the infrared light emitting and receiving module 51 to the ink remaining amount sensing module 400, the quantity of light received by the infrared light emitting and receiving module 51 increases. This makes it possible to determine whether or not the level of the ink has lowered to a predetermined one that can be set using the position of the optical path.

Figure 8E:
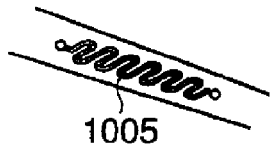
Figure 8C:
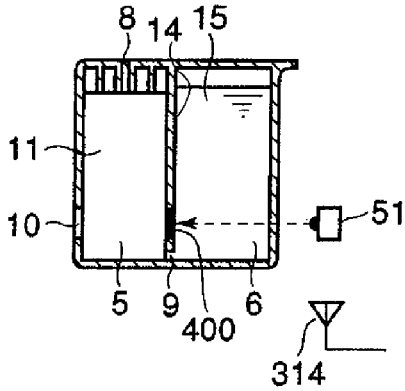

In the configuration shown in FIG. 8C, in an ink tank having the negative pressure generating member accommodating chamber 5 and the ink accommodating chamber 6, the ink remaining amount sensing module 400 is placed on the partitioning wall 14 between the two chambers. This configuration also makes it possible to determine whether or not the level of the ink has lowered to a predetermined one that can be set using the optical path of light emitted by the infrared light emitting and receiving module 51. In this case, the ink remaining amount sensing module 400 is advantageously provided with such a non-contact type of information storage element 311 as shown in FIG. 7A because it does not face the outer surface of the ink tank. Thus, the position at which the ink remaining amount sensing module 400 is installed is not limited to the outer wall of the ink tank.

In the configuration shown in FIG. 8D, in an ink tank in which the ink supply port 10 and an air communication portion 1005 are formed at the bottom of an ink accommodating chamber directly accommodating ink, a concave portion 25 is formed in a side wall of the ink accommodating chamber. FIG. 8E is a diagram of the structure of the air communication portion 1005 of the ink tank as viewed from the bottom surface of the ink tank. The ink remaining amount sensing module 400 is placed on a wall formed by the concave portion 25 and facing the bottom surface of the ink accommodating chamber.

With this configuration, once the amount of ink 15 has decreased in such a way that its level lowers below the wall formed by the concave portion 25 and facing the bottom surface of the ink accommodating chamber, the quantity of light received by the infrared light emitting and receiving module 51 varies in correlation with the remaining amount of the ink 15. This enables the determination of the remaining amount of the ink 15. This configuration is advantageous for sensing the remaining amount of ink 15 having a relatively low light transmittance, for example, pigment ink. That is, even if a large amount of ink 15 remains, it is possible to set a relatively short distance over which light emitted by the light emitting and receiving module 51 travels through the ink 15, and to detect the reflected light. This configuration may be adapted so that the ink remaining amount is estimated using a well-known dot count system from an initial state in which the ink tank is full of the ink 15 until the remaining amount becomes a predetermined value determined by the position where the concave portion 25 is formed, for example, a quarter of the full amount. This makes it possible to roughly estimate the ink remaining amount until a quarter of the full amount and to subsequently determine the ink remaining amount more accurately by using a sensing signal from the infrared light emitting and receiving module 51.

As described above, the ink remaining amount sensing module 400 according to the present embodiment can be applied in various manners. This also applies to the embodiments described below. Further, in these applied examples, the ink tank need not be wholly transparent. The ink tank may be partly transparent so that light emitted by the light emitting and receiving module 51 can reach the optical reflector of the ink remaining amount sensing module 400 through the ink accommodating chamber and that light reflected by the optical reflector can return to the infrared light emitting and receiving module 51. This configuration is suitable to avoid entering of light from the outside into the ink tank, resulting minimizing adverse affect to an amount of light entering into the light receiving section of the module 51.

Second Embodiment

Figure 9A:
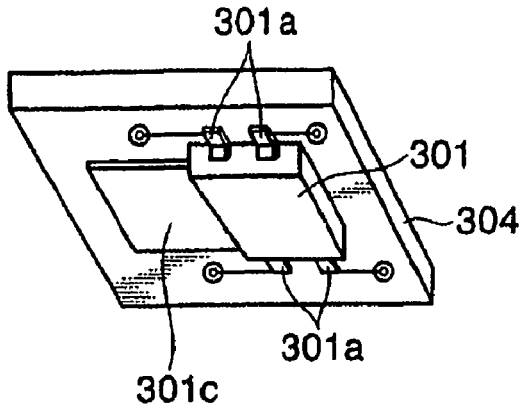
FIG. 9A is a perspective view showing the configuration of an ink remaining amount sensing module according to a second embodiment of the present invention.

FIG. 9A is a schematic diagram of an ink remaining amount sensing module provided in an ink tank according to a second embodiment of the present invention.

In the present embodiment, in contrast to the optical reflector 444 according to the first embodiment, an optical reflector 301*c* is formed utilizing a lead frame used to form a lead terminal 301*a* in mold-packaging the information storage element 301. Solder plating does not provide a high reflectance, so that the lead frame is desirably plated with gold. The optical reflector may be an aluminum reflection film, which exhibits a high reflectance of about 90% for light over a wide wavelength band. However, gold exhibits a reflectance of less than 40% in a near ultraviolet region but a high reflectance of 97 to 98% in an infrared region. Accordingly, gold can be effectively utilized as an optical reflector. Further, the gold reflector is desirable because it is more resistant to corrosion than the aluminum reflector.

Third Embodiment

Figure 9B:
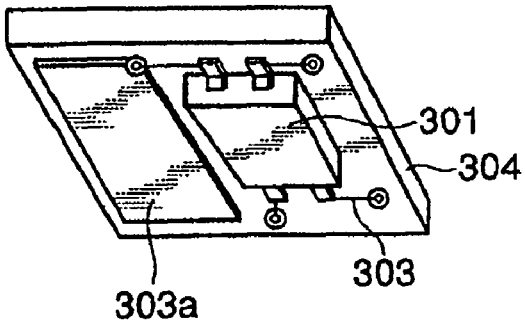
FIG. 9B is a perspective view showing the configuration of an ink remaining amount sensing module according to a third embodiment of the present invention.

FIG. 9B is a schematic diagram of an ink remaining amount sensing module provided in an ink tank according to a third embodiment of the present invention.

In the present embodiment, an optical reflector 303*a* is composed of a wiring member formed in a wide area of a wiring pattern formed on a printed circuit board as the support substrate 304. As in the case of the second embodiment, the wiring member is desirably plated with gold. However, a copper pattern used for common wiring members may be used provided that a sealing adhesive can be used to form a barrier against external environments. Further, measures are desirably taken for corrosion, migration, and the like. However, if it is undesirable to increase costs by employing gold plating, the copper pattern may be plated with nickel. In this case, a reflectance (about 70%) is obtained which is comparable to that of the stainless steel mirror shown in the first embodiment.

Fourth Embodiment

Figure 9C:
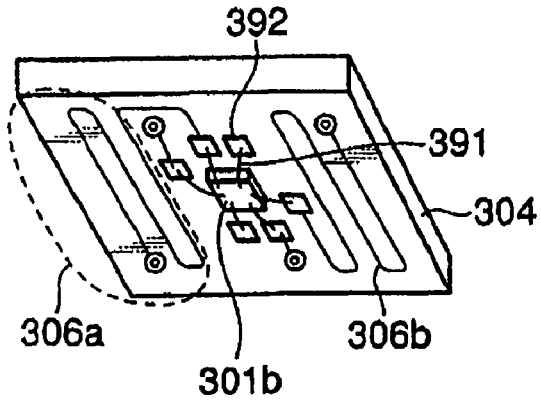
FIG. 9C is a perspective view showing the configuration of an ink remaining amount sensing module according to a fourth embodiment of the present invention.

FIG. 9C is a schematic diagram of an ink remaining amount sensing module provided in an ink tank according to a fourth embodiment of the present invention.

In the present embodiment, a non-contact type of information storage element 301*b* is mounted on the support substrate; the non-contact type of information storage element 301*b* is in a bare chip form rather than being mold-packaged. The information storage element 301*b* connects to an electromagnetic coupling coil pattern or antenna patterns 306*a* and 306*b* for communications with a communication portion provided in the ink jet printing apparatus main body. Connections to and from the non-contact type information storage element 301*b* are made via wire leads and pads, such as 391 and 392, respectively. In the present embodiment, the antenna patterns 306*a* and 306*b* are used as an optical reflector. In the antenna patterns 306*a* and 306*b*, gaps are created within a wiring member serving as an optical reflector. This reduces reflectance per unit area. However, a light beam from a light source to the optical reflector has a width of at least 1 to 2 mm. This makes it possible to effectively utilize the antenna patterns 306*a* and 306*b* as an optical reflector.

In the second to fourth embodiments, the surface on which the information storage element 301 or 301*b* is mounted is not limited to the surface on which the optical reflector 301*c* or 303*a* or the antenna patterns, serving as an optical reflector, is mounted. Further, in the second and third embodiment, the information storage element 301 may be in a bare chip form rather than being mold-packaged or may be in a non-contact form.

Fifth Embodiment

Figure 10A:
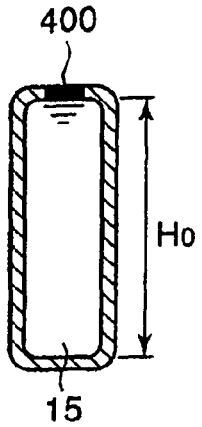
FIGS. 10A to 10D are diagrams illustrating a fifth embodiment of the present invention.
Figure 10B:
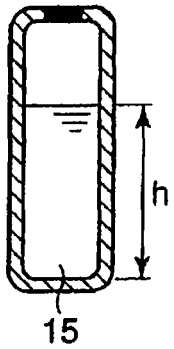
Figure 10C:
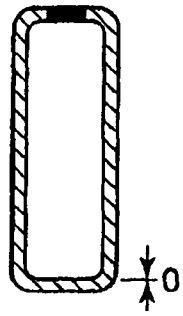

FIGS. 10A to 10C are sectional views of an ink accommodating chamber of an ink tank according to a fifth embodiment as viewed from a lateral direction. FIG. 10A shows an initial state of the ink tank in which the ink accommodating chamber is full. The height h of the ink 15 is H0 and is almost equal to the height of the ink accommodating chamber. In this state, as the ink is consumed, the height of the ink 15 decreases as shown in FIG. 10B. Finally, as shown in FIG. 10C, the ink tank becomes empty, that is, the height h of the ink 15 becomes zero.

With this ink tank, the module 51 for emitting or receiving infrared light is used to determine the remaining amount of the ink 15 on the basis of the quantity of light passing through the ink 15 as shown in the first embodiment. Thus, the ink jet printing apparatus is provided with the light emitting and receiving module 51. However, the characteristics of the infrared light emitting and receiving modules 51 normally vary. That is, the received light quantity measured under the same conditions may vary among the light emitting and receiving modules 51 owing to a variation in the light emission characteristic of a light emitting diode provided in the light emitting section 52, the conversion characteristic of a photo transistor that converts received light into a current, or the characteristics of lenses provided in the light emitting section 52 and the light receiving section 53.

It is very difficult to manufacture a large number of light emitting and receiving modules 51 while limiting the variation to within a narrow range. To obtain light emitting and receiving modules 51 having a predetermined range of characteristics, it is necessary to test all finished modules to sort out those having the predetermined range of characteristics. This increases the manufacturing cost of the light emitting and receiving module and thus the ink jet printing apparatus. In fact, even if the received light quantity measured under the same conditions varies by a factor of about 10 to 20, if this variation is allowable, the manufacturing cost can be drastically reduced. The present embodiment provides a configuration that can accurately determine the ink remaining amount even if the characteristics of the light emitting and receiving modules 51 vary to some degree.

Figure 11:
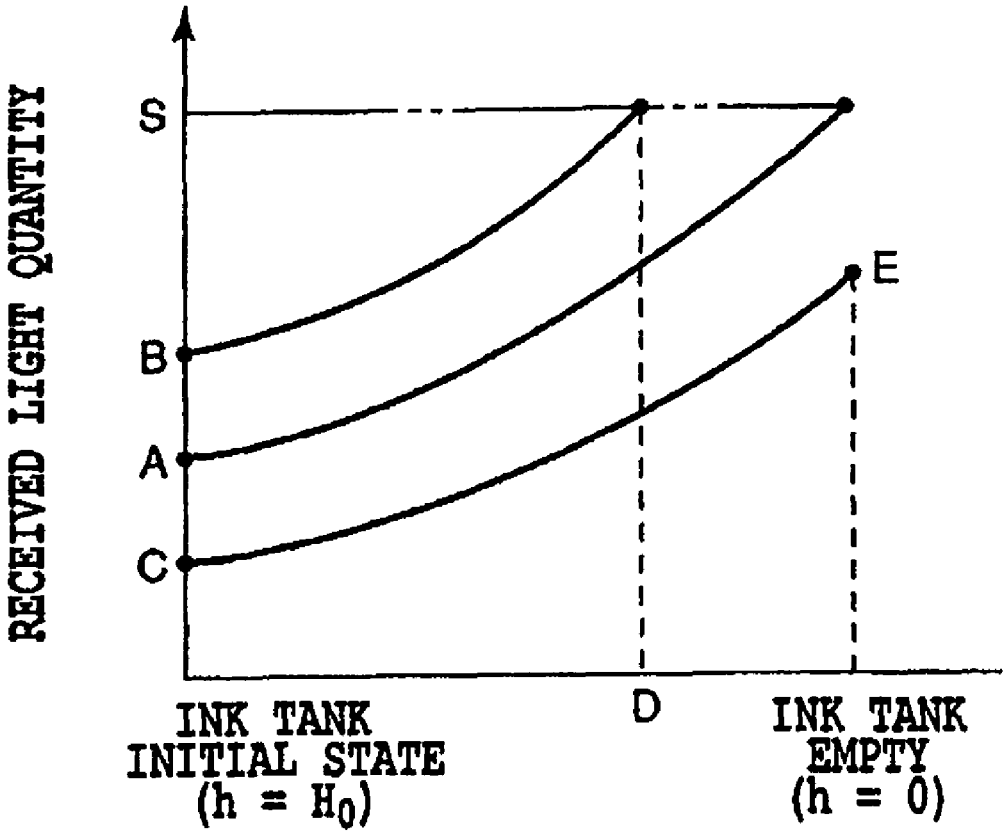
FIG. 11 is a graph showing a variation in the quantity of light received by the ink remaining amount sensing module, vs. a variation in ink remaining amount.

FIG. 11 is a graph showing a variation in received light quantity measured using three infrared light emitting and receiving modules with the characteristics A, B, and C, vs. the ink remaining amount. As shown in this figure, the received light quantity of the light emitting and receiving modules 51 varies so as to draw a specific characteristic curve with respect to a variation in ink remaining amount, that is, a variation in the length of the part of the optical path in which the ink is present. The characteristic curve is determined by the type of the ink accommodated in the ink accommodating chamber and the configuration of the ink accommodating chamber (including the tolerance of reflectance of the optical reflector, the tolerance of inclination of the optical reflector, and the tolerance of transmittance of the material of the housing forming the ink accommodating chamber and the sealing adhesive). In this case, the variation in characteristics results in differences in received light quantity among the infrared light emitting and receiving modules with the characteristics A, B, and C. Here, it is assumed that with the light emitting and receiving module 51 with the characteristic A, the ink accommodating chamber becomes empty when the received light quantity reaches S. Then, with the light emitting and receiving module 51 with the characteristic B, when the received light quantity reaches S, the ink accommodating chamber is determined to be empty even though the height of the ink 15 is D, that is, there still remains an amount of ink 15. On the other hand, with the light emitting and receiving module 51 with the characteristic C, the height of the ink 15 becomes E before the received light quantity reaches S. That is, the ink tank becomes empty even though the ink tank has not been determined to be empty.

Figure 10D:
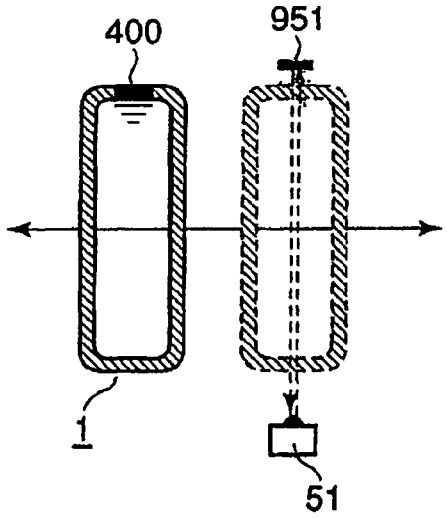

Thus, in the present embodiment, a standard reflector 951 is placed opposite the light emitting and receiving module 51 as shown in FIG. 10D. The carriage is operated to move the ink tank away from above the infrared light emitting and receiving module 51. Then, the light emitting section irradiates the standard optical reflector 951 with light. The quantity of light reflected by the standard reflector 951 is then measured. The measurement is not affected by the conditions for the ink tank such as the ink remaining amount but correlates only with the characteristics of the infrared light emitting and receiving module 51. Thus, the measurement can be used to calibrate a variation in characteristics among the light emitting and receiving modules 51 to eliminate the adverse effects on the measured received light quantity.

In the process procedure shown in FIG. 6, step S1 may follow the process of measuring the quantity of light reflected by the optical reflector 951. The calibrating process may precede step S2.

As described above, according to the present embodiment, even if the characteristics of the infrared light emitting and receiving modules 51 vary, it is possible to correct the adverse effects, on the determination of the ink remaining amount, of the variation in characteristics among the infrared light emitting and receiving modules 51. Therefore, even if the ink tank has a factor causing a variation of up to about 10%, the ink remaining amount can be determined very accurately. This allows the use of inexpensive infrared light emitting and receiving modules 51, enabling the ink remaining amount to be sensed inexpensively and accurately.

Sixth Embodiment

Figure 12A:
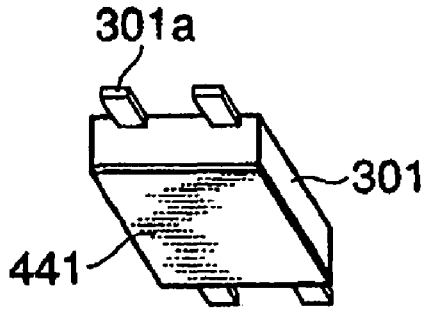
FIGS. 12A and 12B are perspective views showing two examples of configuration of an ink remaining amount sensing module according to a sixth embodiment of the present invention.
Figure 12B:
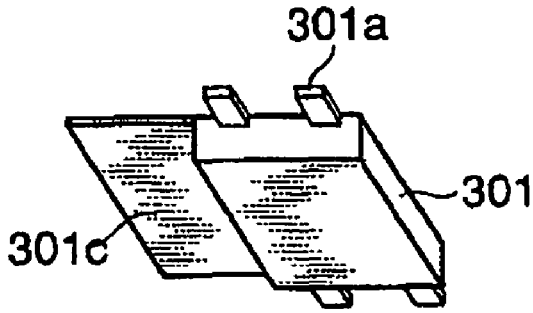
Figure 13A:
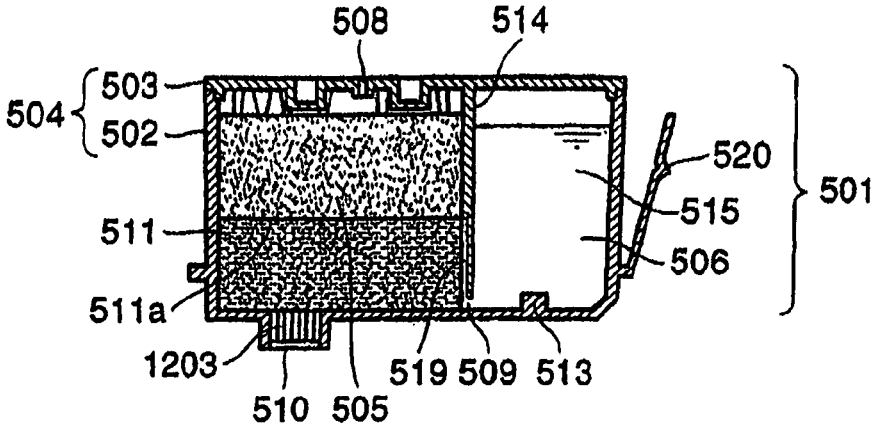
FIG.13A PRIOR ART
Figure 13B:
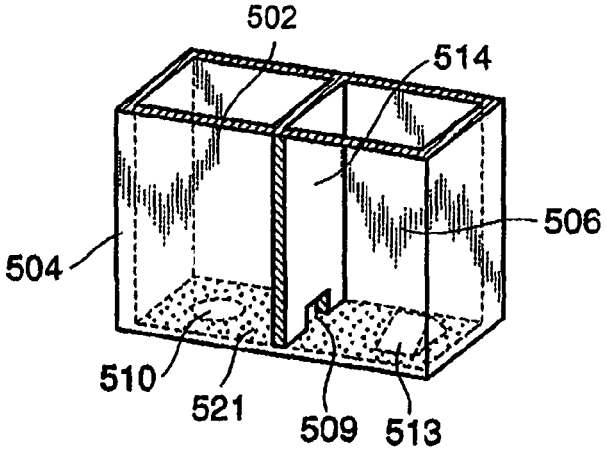
FIG.13B PRIOR ART
Figure 13C:
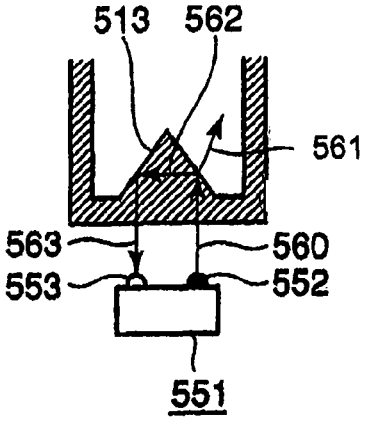
FIG.13C PRIOR ART

The examples shown in the first to third embodiments use the ink remaining amount sensing module on which the information storage element 301 or 311 is mounted on the support member 304. However, the support member 304 is not essential. FIGS. 12A and 12B show two examples of an ink remaining amount sensing module according to the present embodiment.

In the present embodiment, as shown in FIG. 12A, an ink remaining amount sensing module is obtained by providing the packaged information storage element 301 with an optical reflector 441 similar to that shown in the first embodiment. Alternatively, as shown in FIG. 12B, an ink remaining amount sensing module is obtained by providing the packaged information storage element 301 with an optical reflector 301*c* formed using a lead frame as shown in the second embodiment.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes.

This application claims priority from Japanese Patent Application No. 2004-135851 filed Apr. 20, 2004, which is hereby incorporated by reference herein.

The invention claimed is:

1. An ink tank comprising:

a housing having an ink accommodating chamber, the ink accommodating chamber including a bottom wall and a side wall defined by an in-use orientation of the ink tank, wherein at least a portion of the bottom wall is light transmissive; and wherein a concave portion is formed at the side wall, the ink tank further comprising:

an optical reflector embedded in a wall formed by the concave portion which faces the bottom wall, wherein the optical reflector reflects a light emitted from an exterior of the bottom wall and transmitted through the light transmissive portion of the bottom wall across an inside of the ink accommodating chamber, and leads reflected light to a light receiving section located at the exterior of the bottom wall.

2. The ink tank according to claim 1, wherein the optical reflector is a board like shape and is embedded in the wall of the concave portion.

3. The ink tank according to claim 1, further comprising an information storage element;

wherein the optical reflector and the information storage element are embedded in the same portion of the wall of the concave portion.

4. The ink tank according to claim 1, wherein an ink amount in the ink accommodating chamber is detected in accordance with light quantity received by the light receiving section.

5. The ink tank according to claim 4, wherein the light quantity received by the light receiving section increases progressively as the ink amount decreases.

6. The ink tank according to claim 1, wherein the optical reflector is embedded in the wall of the concave portion out of contact with the ink.

7. The ink tank according to claim 1, wherein the reflected light proceeds across the inside of the ink accommodating chamber through an optical path that remains substantially the same regardless of whether the ink is present or is not present in the ink accommodating chamber.

8. The ink tank according to claim 1, wherein the concave portion is formed at a position corresponding to approximately one-quarter of a full amount of ink in the ink accommodating chamber.

9. The ink tank according to claim 1, wherein the wall of the concave portion is a horizontal wall in an in-use orientation of the ink tank.

10. The ink tank according to claim 1, further comprising an ink supply port in the bottom wall of the ink accommodating chamber.

11. The ink tank according to claim 1, further comprising an ink supply port and an air communication portion in the bottom wall of the ink accommodating chamber.

* * * * *